US010213890B2

(12) United States Patent
Xue et al.

(10) Patent No.: US 10,213,890 B2
(45) Date of Patent: Feb. 26, 2019

(54) DEBURRING DEVICE FOR BACK CAVITY OF WHEEL

(71) Applicant: CITIC Dicastal CO., LTD., Qinhuangdao, Hebei (CN)

(72) Inventors: Bowen Xue, Qinhuangdao (CN); Jiandong Guo, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 164 days.

(21) Appl. No.: 15/603,693

(22) Filed: May 24, 2017

(65) Prior Publication Data

US 2017/0348816 A1 Dec. 7, 2017

(30) Foreign Application Priority Data

Jun. 1, 2016 (CN) ..... 2016 1 0381213

(51) Int. Cl.
*B24B 5/44* (2006.01)
*B24B 9/04* (2006.01)
(Continued)

(52) U.S. Cl.
CPC ..... *B24B 5/44* (2013.01); *B24B 9/04* (2013.01); *B24B 29/005* (2013.01); *B24B 41/00* (2013.01); *B24B 41/06* (2013.01); *B24B 47/10* (2013.01)

(58) Field of Classification Search
CPC .. B24B 9/00; B24B 9/002; B24B 9/04; B24B 27/00; B24B 29/00; B24B 29/005;
(Continued)

(56) References Cited

U.S. PATENT DOCUMENTS

2015/0352680 A1 12/2015 Poliquin

FOREIGN PATENT DOCUMENTS

CN 102935608 A 2/2013
CN 203600007 U * 5/2014
(Continued)

OTHER PUBLICATIONS

CN-203600007 translation, Espacenet website (Year: 2018).*
CN-203817909 translation, Espacenet website (Year: 2018).*

*Primary Examiner* — Joseph J Hail
*Assistant Examiner* — Timothy Brian Brady
(74) *Attorney, Agent, or Firm* — Syncoda LLC; Feng Ma

(57) ABSTRACT

Disclosed is a deburring device for a back cavity of a wheel, composed of a machine frame, a clamping and rotating system, a rising and falling translation system and brush units. Jaws clamp a wheel on a roller way, upper cylinders enable the wheel to rise through four upper guide posts, and a first servo motor enables the wheel to move to upsides of conical sleeves through a second gear rack and a second gear; the upper cylinders enable the wheel to fall, and outer sides of the four jaws are in fit with the conical sleeves; a second motor enables the wheel to rotate in a clamped state; a first motor drives a bottom plate and a brush system to rotate in a circumferential direction through a first synchronizing belt; a second servo motor drives a first brush to rotate, a third servo motor drives a second brush to rotate, and brush hairs of the two brushes apply brushing forces of different directions to a back cavity of the wheel; a direction of rotation of the wheel is opposite to that of the brush system; and lower cylinders enable the brush system to rise through lower guide posts, and the brush system can carry out deburring when the brush system is in contact with the back cavity of the wheel.

3 Claims, 4 Drawing Sheets

(51) Int. Cl.

| | |
|---|---|
| ***B24B 29/00*** | (2006.01) |
| ***B24B 41/00*** | (2006.01) |
| ***B24B 41/06*** | (2012.01) |
| ***B24B 47/10*** | (2006.01) |

(58) Field of Classification Search
CPC ..... B24B 5/44; B24B 31/00; B24B 41/00; B24B 41/06; B24J 9/08; B24D 13/02; B25J 9/08; B25J 9/10
USPC ..... 451/51, 59, 61, 246, 249, 254, 258
See application file for complete search history.

(56) References Cited

FOREIGN PATENT DOCUMENTS

| | | | | |
|---|---|---|---|---|
| CN | 103921188 | A | | 7/2014 |
| CN | 203817909 | U | * | 9/2014 |
| CN | 203817909 | U | | 9/2014 |
| CN | 205630194 | U | | 10/2016 |

* cited by examiner

DEBURRING DEVICE FOR BACK CAVITY OF WHEEL

CROSS-REFERENCE TO RELATED APPLICATIONS

This application is filed based upon and claims priority to Chinese Patent Application No. 201610381213.2, filed on Jun. 1, 2016, the entire contents of which are incorporated herein by reference.

TECHNICAL FIELD

The disclosure relates to a deburring device, and in particular to a deburring device, capable of automatically adjusting size of a brush system, for a back cavity of a wheel.

BACKGROUND

For aluminum-alloy wheel production enterprises, no very ideal deburring method for burrs formed after machining is present as yet, and deburring modes of the traditional deburring equipment are too single, so that the requirements of wheels of complicated shapes on deburring cannot be met at all; and furthermore, a majority of production enterprises adopt mixed-line production at present, i.e., wheels of different sizes simultaneously flow on various working procedures of a production line, so that very large limitations to the deburring equipment are present. A corresponding brush system must be replaced when the wheels of different sizes are switched, and thus the production efficiency is seriously affected.

SUMMARY

An object of the disclosure is to provide a wheel deburring device, which has the advantages that the size of a brush system can be automatically adjusted, brushing forces of different directions to a back cavity of a wheel can be formed during deburring, and burrs of each direction can be better removed.

In order to achieve the object described above, a technical solution of the disclosure is as follows: a deburring device for a back cavity of a wheel is composed of a machine frame, lower guide posts, a first motor, a first belt pulley, lower guide sleeves, a lower rising and falling plate, a first synchronizing belt, a second belt pulley, a central shaft, a lower rotary shaft, a lower bearing block, a rotary table, conical sleeves, jaws, a left sliding plate, a first guide rail, first gear racks, a first gear, a rotating plate, an upper rotary shaft, an upper bearing block, an upper rising and falling plate, upper guide posts, a second motor, upper guide sleeves, upper cylinders, a lower plate, a roller way, a stopper, lower cylinders, a third motor, a third belt pulley, a second synchronizing belt, a fourth belt pulley, a clamping cylinder, a vertical plate, a cross rail, a second gear rack, a second gear, a first servo motor, a top plate, a bottom plate, a second guide rail, a first brush, a lower brush wheel, a lower supporting plate, a lower vertical plate, a fifth belt pulley, a second servo motor, a third synchronizing belt, a first brush disc, an upper brush wheel, a sixth belt pulley, an upper vertical plate, a third gear rack, a fourth gear rack, a second brush disc, a second brush, a third servo motor, a right sliding plate and a fixing table. Four lower guide posts are fixed between the bottom surface of the machine frame and an upper platform; four lower guide sleeves matched with the lower guide posts are fixed on the lower rising and falling plate; both the first motor, of which an output end is provided with the first belt pulley, and the third motor, of which an output end is provided with the fourth belt pulley, are fixed below the lower rising and falling plate; the lower bearing block is fixed above the lower rising and falling plate; the lower rotary shaft is mounted in the lower bearing block through a bearing, the second belt pulley is mounted at the lower end of the lower rotary shaft, and the bottom plate is fixed at the upper end of the lower rotary shaft; the central shaft is mounted in the lower rotary shaft through a bearing, the third belt pulley is mounted at the lower end of the central shaft, and the upper end of the central shaft is machined into a gear shape; the first belt pulley and the second belt pulley are connected through the first synchronizing belt; the third belt pulley and the fourth belt pulley are connected through the second synchronizing belt; the two lower cylinders are fixed on the bottom surface of the machine frame, and output ends of the two lower cylinders are hinged to the downside of the lower rising and falling plate; the stopper is fixed below the roller way; and the rotary table, of which the upside is provided with the conical sleeves, is fixed on a working platform of the machine frame.

A clamping and rotating system is as follows: the left sliding plate, of which the downside is fixedly provided with two jaws, is mounted below the rotating plate through the first guide rail; the right sliding plate, of which the downside is fixedly provided with two jaws, is also mounted below the rotating plate through the first guide rail; the left sliding plate and the right sliding plate each is fixedly provided with a first gear rack, and the first gear racks are engaged with the first gear; the clamping cylinder is mounted above the left sliding plate, and an output end of the clamping cylinder is hinged to the right sliding plate; the second motor is fixed above the upper rising and falling plate; the upper bearing block is fixed below the upper rising and falling plate; the upper rotary shaft is mounted inside the upper bearing block through a bearing; and the upper end of the upper rotary shaft is connected with an output end of the second motor, and the lower end of the upper rotary shaft is fixed above the rotating plate.

A rising and falling translation system is as follows: the four upper guide posts are fixed above the upper rising and falling plate; the four upper guide sleeves and the two upper cylinders, which are matched with the four upper guide posts, are fixed above the lower plate; output ends of the two upper cylinders are hinged to the upside of the upper rising and falling plate; the lower plate is fixed below the vertical plate; the top plate is fixed above the vertical plate; the vertical plate is fixed on a side face of the fixing table through the cross rail; and the first servo motor is fixed above the top plate, and the second gear is mounted at an output end of the first servo motor and is engaged with the second gear rack which is fixed at the top end of the fixing table.

A brush unit is as follows: the upper brush wheel is mounted on the upper vertical plate above the first brush disc; the lower brush wheel is mounted on the lower vertical plate below the first brush disc, and the first brush is in fit rotation with the lower brush wheel and the upper brush wheel simultaneously; the second servo motor, of which an output end is provided with the fifth belt pulley, is fixed above the lower supporting plate; the sixth belt pulley is mounted in the middle of the upper brush wheel; the fifth belt pulley and the sixth belt pulley are connected through the third synchronizing belt; the third servo motor, of which an output end is provided with the second brush, is fixed below the second brush disc; the third gear rack is mounted on the first brush disc, and the fourth gear rack is mounted on the second brush disc and is engaged with a gear above the central shaft simultaneously; and both the downside of the first brush disc and the downside of the second brush disc are connected with slide rails of the second guide rail, and sliding blocks of the second guide rail are fixed above the bottom plate.

A brush system includes two brush units. Both the first brush disc and the second brush disc are quarter-circle-shaped, and vertically-upward brush hairs are fixed on the first brush disc and the second brush disc except for the first brush and the second brush.

Outer sides of lower ends of the jaws are conical and are fit with inner rings of the conical sleeves; and inner sides of lower ends of the jaws are V-type-block-shaped and are fit with a lower wheel rim of a wheel.

During actual use, the jaws clamp a wheel on the roller way, the upper cylinders enable the wheel to rise through the four upper guide posts, and the first servo motor enables the wheel to move to upsides of the conical sleeves through the second gear rack and the second gear; the upper cylinders enable the wheel to fall, and outer sides of the four jaws are in fit with the conical sleeves and apply certain pressure; the second motor enables the wheel to rotate in a clamped state; the first motor drives the bottom plate and the brush system to rotate in a circumferential direction through the first synchronizing belt; the second servo motor drives the first brush to rotate, the third servo motor drives the second brush to rotate, and brush hairs of the two brushes apply brushing forces of different directions to a back cavity of the wheel; a direction of rotation of the wheel is opposite to that of the brush system; the lower cylinders enable the brush system to rise through the lower guide posts, and the brush system can carry out deburring when the brush system is in contact with the back cavity of the wheel; and for wheels of different sizes, the third motor drives the central shaft to rotate, and positions of the first brush disc and the second brush disc can be adjusted through the third gear rack and the fourth gear rack.

According to the deburring device, when in use, the size of a brush system can be automatically adjusted so as to meet requirements of the wheels of different sizes on deburring, brushing forces of different directions to a back cavity of a wheel can be formed during deburring, and burrs of each direction can be better removed; and meanwhile, the deburring device has the characteristics of high degree of automation, advanced technology, high universality and safe and stable performance.

LIST OF REFERENCE NUMERALS

Figure 1:
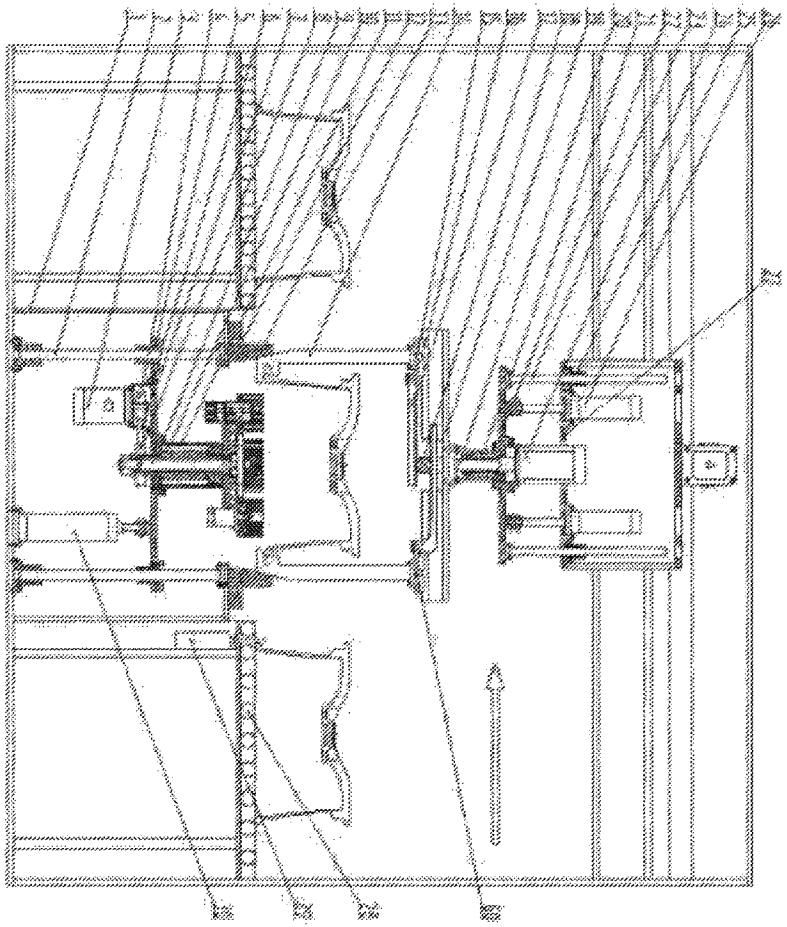
FIG. 1 is a front view of a deburring device for a back cavity of a wheel.
Figure 2:
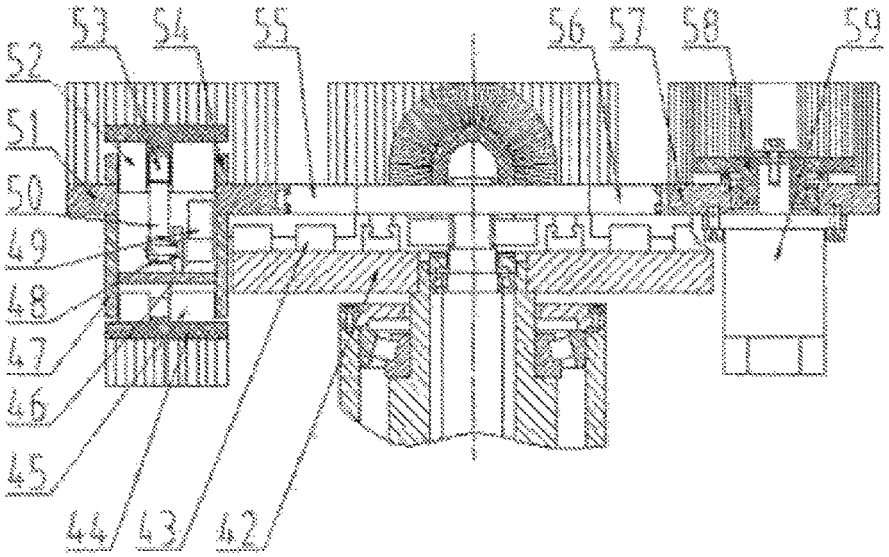
FIG. 2 is a front view of a brush system of a deburring device for a back cavity of a wheel.
Figure 3:
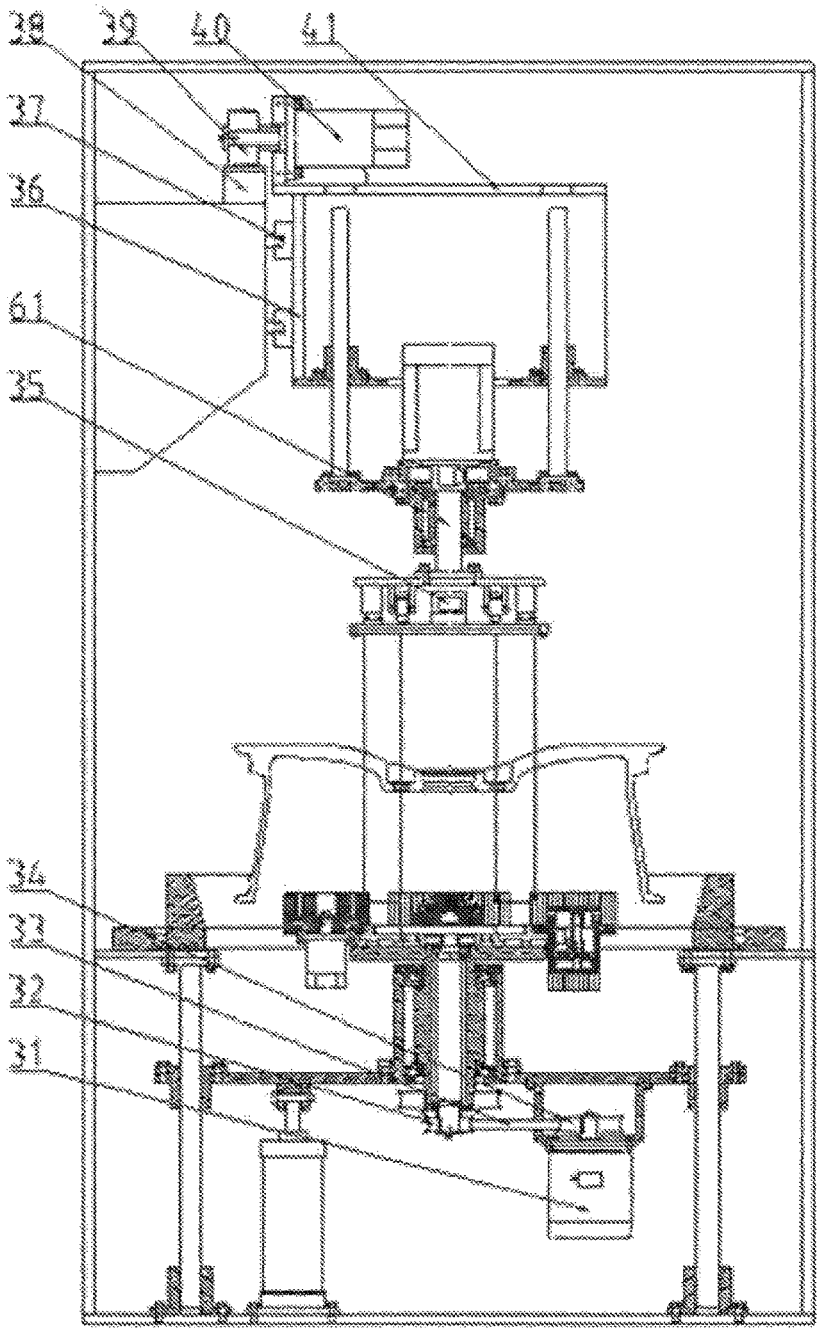
FIG. 3 is a left view of a deburring device for a back cavity of a wheel.
Figure 4:
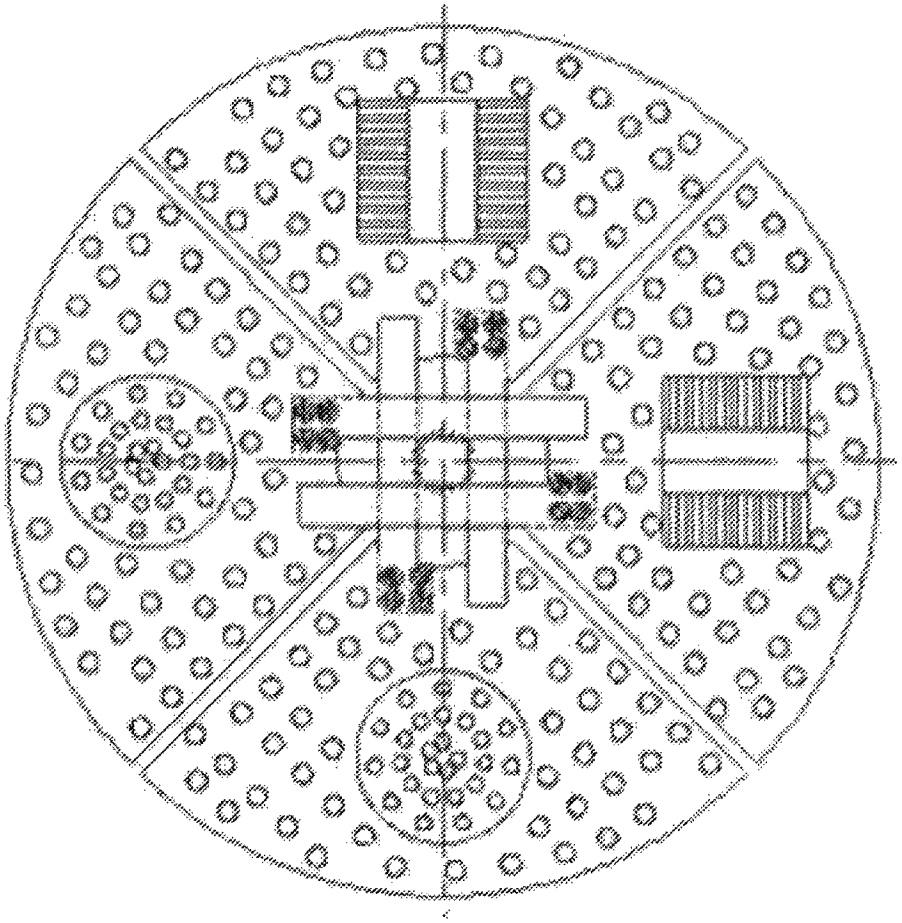
FIG. 4 is a top view of a brush system of a deburring device for a back cavity of a wheel.

1 machine frame
2 lower guide post
3 first motor
4 first belt pulley
5 lower guide sleeve
6 lower rising and falling plate
7 first synchronizing belt
8 second belt pulley
9 central shaft
10 lower rotary shaft
11 lower bearing block
12 rotary table
13 conical sleeve
14 jaw
15 left sliding plate
16 first guide rail
17 first gear rack
18 first gear
19 rotating plate
20 upper rotary shaft
21 upper bearing block
22 upper rising and falling plate
23 upper guide post
24 second motor
25 upper guide sleeve
26 upper cylinder
27 lower plate
28 roller way
29 stopper
30 lower cylinder
31 third motor
32 third belt pulley
33 second synchronizing belt
34 fourth belt pulley
35 clamping cylinder
36 vertical plate
37 cross rail
38 second gear rack
39 second gear
40 first servo motor
41 top plate
42 bottom plate
43 second guide rail
44 first brush
45 lower brush wheel
46 lower supporting plate
47 lower vertical plate
48 fifth belt pulley
49 second servo motor
50 third synchronizing belt
51 first brush disc
52 upper brush wheel
53 sixth belt pulley
54 upper vertical plate
55 third gear rack
56 fourth gear rack
57 second brush disc
58 second brush
59 third servo motor
60 right sliding plate
61 fixing table

DETAILED DESCRIPTION

In the following, the details and working conditions of a specific device provided by the disclosure are described in combination with the figures.

The deburring device is composed of a machine frame 1, lower guide posts 2, a first motor 3, a first belt pulley 4, lower guide sleeves 5, a lower rising and falling plate 6, a first synchronizing belt 7, a second belt pulley 8, a central shaft 9, a lower rotary shaft 10, a lower bearing block 11, a rotary table 12, conical sleeves 13, jaws 14, a left sliding plate 15, a first guide rail 16, first gear racks 17, a first gear 18, a rotating plate 19, an upper rotary shaft 20, an upper bearing block 21, an upper rising and falling plate 22, upper guide posts 23, a second motor 24, upper guide sleeves 25, upper cylinders 26, a lower plate 27, a roller way 28, a stopper 29, lower cylinders 30, a third motor 31, a third belt pulley 32, a second synchronizing belt 33, a fourth belt pulley 34, a clamping cylinder 35, a vertical plate 36, a cross rail 37, a second gear rack 38, a second gear 39, a first servo motor 40, a top plate 41, a bottom plate 42, a second guide rail 43, a first brush 44, a lower brush wheel 45, a lower supporting plate 46, a lower vertical plate 47, a fifth belt pulley 48, a second servo motor 49, a third synchronizing belt 50, a first brush disc 51, an upper brush wheel 52, a sixth belt pulley 53, an upper vertical plate 54, a third gear rack 55, a fourth gear rack 56, a second brush disc 57, a second brush 58, a third servo motor 59, a right sliding plate 60 and a fixing table 61; four lower guide posts 2 are fixed between the bottom surface of the machine frame 1 and an upper platform; four lower guide sleeves 5 matched with the lower guide posts 2 are fixed on the lower rising and falling plate 6; both the first motor 3, of which an output end is provided with the first belt pulley 4, and the third motor 31, of which an output end is provided with the fourth belt pulley 34, are fixed below the lower rising and falling plate 6; the lower bearing block 11 is fixed above the lower rising and falling plate 6; the lower rotary shaft 10 is mounted in the lower bearing block 11 through a bearing, the second belt pulley 8 is mounted at the lower end of the lower rotary shaft 10, and the bottom plate 42 is fixed at the upper end of the lower rotary shaft 10; the central shaft 9 is mounted in the lower rotary shaft 10 through a bearing, the third belt pulley 32 is mounted at the lower end of the central shaft 9, and the upper end of the central shaft 9 is machined into a gear shape; the first belt pulley 4 and the second belt pulley 8 are connected through the first synchronizing belt 7; the third belt pulley 32 and the fourth belt pulley 34 are connected through the second synchronizing belt 33; the two lower cylinders 30 are fixed on the bottom surface of the machine frame 1, and output ends of the two lower cylinders 30 are hinged to the downside of the lower rising and falling plate 6; the stopper 29 is fixed below the roller way 28; and the rotary table 12, of which the upside is provided with the conical sleeves 13, is fixed on a working platform of the machine frame 1.

A clamping and rotating system is as follows: the left sliding plate 15, of which the downside is fixedly provided with two jaws 14, is mounted below the rotating plate 19 through the first guide rail 16; the right sliding plate 60, of which the downside is fixedly provided with two jaws 14, is also mounted below the rotating plate 19 through the first guide rail 16; the left sliding plate 15 and the right sliding plate 60 each is fixedly provided with a first gear rack 17, and the first gear racks 17 are engaged with the first gear 18; the clamping cylinder 35 is mounted above the left sliding plate 15, and an output end of the clamping cylinder 35 is hinged to the right sliding plate 60; the second motor 24 is fixed above the upper rising and falling plate 22; the upper bearing block 21 is fixed below the upper rising and falling plate 22; the upper rotary shaft 20 is mounted inside the upper bearing block 21 through a bearing; and the upper end of the upper rotary shaft 20 is connected with an output end of the second motor 24, and the lower end of the upper rotary shaft 20 is fixed above the rotating plate 19.

A rising and falling translation system is as follows: the four upper guide posts 23 are fixed above the upper rising and falling plate 22; the four upper guide sleeves 25 and the two upper cylinders 26, which are matched with the four upper guide posts 23, are fixed above the lower plate 27; output ends of the two upper cylinders 26 are hinged to the upside of the upper rising and falling plate 22; the lower plate 27 is fixed below the vertical plate 36; the top plate 41 is fixed above the vertical plate 36; the vertical plate 36 is fixed on a side face of the fixing table 61 through the cross rail 37; and the first servo motor 40 is fixed above the top plate 41, and the second gear 39 is mounted at an output end of the first servo motor 40 and is engaged with the second gear rack 38 which is fixed at the top end of the fixing table 61.

A brush unit is as follows: the upper brush wheel 52 is mounted on the upper vertical plate 54 above the first brush disc 51; the lower brush wheel 45 is mounted on the lower vertical plate 47 below the first brush disc 51, and the first brush 44 is in fit rotation with the lower brush wheel 45 and the upper brush wheel 52 simultaneously; the second servo motor 49, of which an output end is provided with the fifth belt pulley 48, is fixed above the lower supporting plate 46; the sixth belt pulley 53 is mounted in the middle of the upper brush wheel 52; the fifth belt pulley 48 and the sixth belt pulley 53 are connected through the third synchronizing belt 50; the third servo motor 59, of which an output end is provided with the second brush 58, is fixed below the second brush disc 57; the third gear rack 55 is mounted on the first brush disc 51, and the fourth gear rack 56 is mounted on the second brush disc 57 and is engaged with a gear above the central shaft 9 simultaneously; and both the downside of the first brush disc 51 and the downside of the second brush disc 57 are connected with slide rails of the second guide rail 43, and sliding blocks of the second guide rail 43 are fixed above the bottom plate 42.

A brush system includes two brush units. Both the first brush disc 51 and the second brush disc 57 are quarter-circle-shaped, and vertically-upward brush hairs are fixed on the first brush disc 51 and the second brush disc 57 except for the first brush 44 and the second brush 58.

Outer sides of lower ends of the jaws 14 are conical and are fit with inner rings of the conical sleeves 13; and inner sides of lower ends of the jaws 14 are V-type-block-shaped and are fit with a lower wheel rim of a wheel.

During work, the jaws 14 clamp a wheel on the roller way 28, the upper cylinders 26 enable the wheel to rise through the four upper guide posts 23, and the first servo motor 40 enables the wheel to move to upsides of the conical sleeves 13 through the second gear rack 38 and the second gear 39; the upper cylinders 26 enable the wheel to fall, and outer sides of the four jaws 14 are in fit with the conical sleeves 13 and apply certain pressure; the second motor 24 enables the wheel to rotate in a clamped state; the first motor 3 drives the bottom plate 42 and the brush system to rotate in a circumferential direction through the first synchronizing belt 7; the second servo motor 49 drives the first brush 44 to rotate, the third servo motor 59 drives the second brush 58 to rotate, and brush hairs of the two brushes apply brushing forces of different directions to a back cavity of the wheel; a direction of rotation of the wheel is opposite to that of the brush system; the lower cylinders 30 enable the brush system to rise through the lower guide posts 2, and the brush system can carry out deburring when the brush system is in contact with the back cavity of the wheel; and for wheels of different sizes, the third motor 31 drives the central shaft 9 to rotate, and positions of the first brush disc 51 and the second brush disc 57 can be adjusted through the third gear rack 55 and the fourth gear rack 56.

The invention claimed is:

1. A deburring device for a back cavity of a wheel, the deburring device being composed of a machine frame (1), lower guide posts (2), a first motor (3), a first belt pulley (4), lower guide sleeves (5), a lower rising and falling plate (6), a first synchronizing belt (7), a second belt pulley (8), a central shaft (9), a lower rotary shaft (10), a lower bearing block (11), a rotary table (12), conical sleeves (13), jaws (14), a left sliding plate (15), a first guide rail (16), first gear racks (17), a first gear (18), a rotating plate (19), an upper rotary shaft (20), an upper bearing block (21), an upper rising and falling plate (22), upper guide posts (23), a second motor (24), upper guide sleeves (25), upper cylinders (26), a lower plate (27), a roller way (28), a stopper (29), lower cylinders (30), a third motor (31), a third belt pulley (32), a second synchronizing belt (33), a fourth belt pulley (34), a clamping cylinder (35), a vertical plate (36), a cross rail (37), a second gear rack (38), a second gear (39), a first servo motor (40), a top plate (41), a bottom plate (42), a second guide rail (43), a first brush (44), a lower brush wheel (45), a lower supporting plate (46), a lower vertical plate (47), a fifth belt pulley (48), a second servo motor (49), a third synchronizing belt (50), a first brush disc (51), an upper brush wheel (52), a sixth belt pulley (53), an upper vertical plate (54), a third gear rack (55), a fourth gear rack (56), a second brush disc (57), a second brush (58), a third servo motor (59), a right sliding plate (60) and a fixing table (61); characterized in that, four lower guide posts (2) are fixed between the bottom surface of the machine frame (1) and an upper platform; four lower guide sleeves (5) matched with the lower guide posts (2) being fixed on the lower rising and falling plate (6); both the first motor (3), of which an output end is provided with the first belt pulley (4), and the third motor (31), of which an output end is provided with the fourth belt pulley (34), being fixed below the lower rising and falling plate (6); the lower bearing block (11) being fixed above the lower rising and falling plate (6); the lower rotary shaft (10) being mounted in the lower bearing block (11) through a bearing, the second belt pulley (8) being mounted at the lower end of the lower rotary shaft (10), and the bottom plate (42) being fixed at the upper end of the lower rotary shaft (10); the central shaft (9) being mounted in the lower rotary shaft (10) through a bearing, the third belt pulley (32) being mounted at the lower end of the central shaft (9), and the upper end of the central shaft (9) being machined into a gear shape; the first belt pulley (4) and the second belt pulley (8) being connected through the first synchronizing belt (7); the third belt pulley (32) and the fourth belt pulley (34) being connected through the second synchronizing belt (33); the two lower cylinders (30) being fixed on the bottom surface of the machine frame (1), and output ends of the two lower cylinders (30) being hinged to the downside of the lower rising and falling plate (6); the stopper (29) being fixed below the roller way (28); and the rotary table (12), of which the upside is provided with the conical sleeves (13), being fixed on a working platform of the machine frame (1);

a clamping and rotating system being as follows: the left sliding plate (15), of which the downside is fixedly provided with two jaws (14), being mounted below the rotating plate (19) through the first guide rail (16); the right sliding plate (60), of which the downside is fixedly provided with two jaws (14), being also mounted below the rotating plate (19) through the first guide rail (16); the left sliding plate (15) and the right sliding plate (60) each being fixedly provided with a first gear rack (17), and the first gear racks (17) being engaged with the first gear (18); the clamping cylinder (35) being mounted above the left sliding plate (15), and an output end of the clamping cylinder (35) being hinged to the right sliding plate (60); the second motor (24) being fixed above the upper rising and falling plate (22); the upper bearing block (21) being fixed below the upper rising and falling plate (22); the upper rotary shaft (20) being mounted inside the upper bearing block (21) through a bearing; and the upper end of the upper rotary shaft (20) being connected with an output end of the second motor (24), and the lower end of the upper rotary shaft (20) being fixed above the rotating plate (19);

a rising and falling translation system being as follows: the four upper guide posts (23) being fixed above the upper rising and falling plate (22); the four upper guide sleeves (25) and the two upper cylinders (26), which are matched with the four upper guide posts (23), being fixed above the lower plate (27); output ends of the two upper cylinders (26) being hinged to the upside of the upper rising and falling plate (22); the lower plate (27) being fixed below the vertical plate (36); the top plate (41) being fixed above the vertical plate (36); the vertical plate (36) being fixed on a side face of the fixing table (61) through the cross rail (37); and the first servo motor (40) being fixed above the top plate (41), and the second gear (39) being mounted at an output end of the first servo motor (40) and being engaged with the second gear rack (38) which is fixed at the top end of the fixing table (61); and a brush unit being as follows: the upper brush wheel (52) being mounted on the upper vertical plate (54) above the first brush disc (51); the lower brush wheel (45) being mounted on the lower vertical plate (47) below the first brush disc (51), and the first brush (44) being in fit rotation with the lower brush wheel (45) and the upper brush wheel (52) simultaneously; the second servo motor (49), of which an output end is provided with the fifth belt pulley (48), being fixed above the lower supporting plate (46); the sixth belt pulley (53) being mounted in the middle of the upper brush wheel (52); the fifth belt pulley (48) and the sixth belt pulley (53) being connected through the third synchronizing belt (50); the third servo motor (59), of which an output end is provided with the second brush (58), being fixed below the second brush disc (57); the third gear rack (55) being mounted on the first brush disc (51), and the fourth gear rack (56) being mounted on the second brush disc (57) and being engaged with a gear above the central shaft (9) simultaneously; and both the downside of the first brush disc (51) and the downside of the second brush disc (57) being connected with slide rails of the second guide rail (43), and sliding blocks of the second guide rail (43) being fixed above the bottom plate (42).

2. The deburring device for a back cavity of a wheel according to claim 1, characterized in that, the brush system comprises two brush units, both the first brush disc (51) and the second brush disc (57) are quarter-circle-shaped, and vertically-upward brush hairs are fixed on the first brush disc (51) and the second brush disc (57) except for the first brush (44) and the second brush (58).

3. The deburring device for a back cavity of a wheel according to claim 1, characterized in that, outer sides of lower ends of the jaws (14) are conical and are fit with inner rings of the conical sleeves (13); and in that inner sides of lower ends of the jaws (14) are V-type-block-shaped and are fit with a lower wheel rim of a wheel.

* * * * *